US008727119B2

(12) United States Patent
Hsiao et al.

(10) Patent No.: US 8,727,119 B2
(45) Date of Patent: May 20, 2014

(54) STACKABLE LIQUID CRYSTAL GLASS PANEL PACKAGING BOX

(75) Inventors: Yuchun Hsiao, Guangdong (CN); Qinjun Shi, Guangdong (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 22 days.

(21) Appl. No.: 13/517,977

(22) PCT Filed: May 25, 2012

(86) PCT No.: PCT/CN2012/076025

§ 371 (c)(1), (2), (4) Date: Jun. 20, 2012

(87) PCT Pub. No.: WO2013/166755

PCT Pub. Date: Nov. 14, 2013

(65) Prior Publication Data

US 2013/0299385 A1 Nov. 14, 2013

(51) Int. Cl.

*B65D 85/48* (2006.01)
*B65D 21/032* (2006.01)
*B65D 81/02* (2006.01)

(52) U.S. Cl.

USPC ..... 206/454; 206/508; 206/509; 206/523; 206/588; 206/592

(58) Field of Classification Search

USPC ..... 206/449, 454, 503, 505, 508, 509, 518, 206/521, 523, 587–594

See application file for complete search history.

(56) References Cited

U.S. PATENT DOCUMENTS

| | | | | |
|---|---|---|---|---|
| 1,587,167 | A * | 6/1926 | Marsden | 206/518 |
| 3,695,424 | A * | 10/1972 | Cristy et al. | 206/509 |
| 7,854,327 | B2 * | 12/2010 | Hyobu | 206/454 |
| 2002/0096447 | A1 | 7/2002 | Lafond et al. | |
| 2007/0095703 | A1 * | 5/2007 | Kao et al. | 206/454 |
| 2008/0128310 | A1 * | 6/2008 | Kao et al. | 206/521 |
| 2011/0215019 | A1 * | 9/2011 | Wu et al. | 206/523 |

FOREIGN PATENT DOCUMENTS

CN 201990010 U 9/2011

* cited by examiner

*Primary Examiner* — Bryon Gehman
(74) *Attorney, Agent, or Firm* — Cheng-Ju Chiang

(57) ABSTRACT

The present invention provides a liquid crystal glass panel packaging box, which includes upper and lower cover members. The upper cover member has a top plate and upper side plates connected to the top plate. The lower cover member has a bottom plate and lower side plates connected to the bottom plate to collectively define a receiving chamber having an opening for receiving a liquid crystal glass panel. The bottom plate of the lower cover member having an outside surface that forms a raised portion corresponding to a circumference of the opening of the receiving chamber. The raised portion of the lower cover member of one liquid crystal panel packaging box is receivable in the opening of the receiving chamber of the lower cover member of another liquid crystal panel packaging box to effect stacking of lower cover members of different liquid crystal panel packaging boxes.

7 Claims, 4 Drawing Sheets

STACKABLE LIQUID CRYSTAL GLASS PANEL PACKAGING BOX

BACKGROUND OF THE INVENTION

1. Field of the Invention

The present invention relates to the field of manufacture of liquid crystal display, and in particular to a liquid crystal glass panel packaging box.

2. The Related Arts

In the field of manufacture of liquid crystal displays, the manufacture of liquid crystal display includes a process of assembling, namely components, such as liquid crystal glass panel, control circuit, and casing, are assembled together. These components are made previously and are properly packaged for warehousing for the subsequent operation of assembling to form a liquid crystal display. The liquid crystal glass panel, after being made, is packaged and stored in a liquid crystal glass panel packaging box, which is then shipped to corresponding assembling station.

As shown in FIGS. 1 and 2, an existing mass-produced liquid crystal glass panel packaging box comprises an upper cover member 100 and a lower cover member 300, which can be secured to each other. The upper and lower cover members 100, 300, after being secured together, forms an enclosed packaging box and a liquid crystal glass panel can be positioned in the packaging box. For easy warehousing and transportation, these packaging boxes are usually stacked. In other words, the lower cover member 300 of one packaging box is positioned on the upper cover member 100 of another packaging box. To stabilize the stack of the packaging boxes, projections 304 are provided on a bottom face of a bottom plate 302 of the lower cover member 300 and corresponding to the projections 304, receiving troughs 104 are formed in a top face of a top plate 102 of the upper cover member 100. To stack, the projections 304 of the bottom plate 302 of the lower cover 300 are fit in the receiving troughs 104 of the top plate 102 of the top cover 100 in order to prevent relative sliding motion between the lower cover member 300 and the upper cover member 100 thereby ensuring stability of the stack, reducing time required for handling, and also saving the floor area required for storage.

However, in the subsequent operation of manufacturing liquid crystal display, when it is time to use the liquid crystal glass panel positioned in the packaging box, before it is conveyed into the manufacture line, the upper cover member 100 must be removed first. However, removal of the upper cover member 100 makes it no longer possible to stack, whereby simultaneously feeding in multiple boxes is not possible and an operator of the manufacture line can only feed in the glass panels in a box-by-box manner. This causes inconvenience of operation, extension of feeding time, and deterioration of manufacturing performance.

SUMMARY OF THE INVENTION

An object of the present invention is to provide a liquid crystal glass panel packaging box, which comprises a lower cover member that allows stacking to be effected between lower cover members and thus simultaneous feeding of multiple boxes to a manufacture line is made possible to thereby improving feeding performance of a manufacture line operator, shortening working hours, and reducing manufacture costs.

To achieve the object, the present invention provides a liquid crystal glass panel packaging box, which comprises an upper cover member and a lower cover member that is mateable with the upper cover member. The upper cover member comprises a top plate and upper side plates connected to the top plate. The lower cover member comprises a bottom plate and lower side plates connected to the bottom plate. The lower side plates and the bottom plate collectively define a receiving chamber having an opening for receiving a liquid crystal glass panel therein. The bottom plate of the lower cover member has an outside surface that is away from the receiving chamber and forms a raised portion that corresponds to a circumference of the opening of the receiving chamber, whereby the raised portion of the lower cover member of one liquid crystal panel packaging box is receivable in the opening of the receiving chamber of the lower cover member of another liquid crystal panel packaging box to effect stacking of lower cover members of different liquid crystal panel packaging boxes.

The top plate of the upper cover member has a top surface forming a receiving cavity corresponding to the raised portion of the bottom plate of the lower cover member to allow the raised portion of the bottom plate of the lower cover member of one liquid crystal panel packaging box to be receivable in the receiving cavity of the top plate of the upper cover member of another liquid crystal panel packaging box to effect stacking between the lower cover member and the upper cover member of different liquid crystal panel packaging boxes.

The receiving cavity of the top plate of the upper cover member has a circumference that corresponds to an outer circumference of the raised portion or is shifted outward with respect to the outer circumference of the raised portion.

The raised portion has an outer circumference that is in alignment with an inner circumference of the lower side plates or is inwardly shifted with respect to the inner circumference of the lower side plates.

The raised portion is of a rectangular structure.

The raised portion forms a plurality of grooves.

The lower side plates of the lower cover member form a mounting section in outside surfaces thereof at ends adjacent to the upper cover member and the upper side plates of the upper cover member form an engaging section, which corresponds to the mounting section, in inside surfaces thereof at ends adjacent to the lower cover member to mate and couple with the mounting section, thereby effecting mating engagement between the upper cover member and the lower cover member.

The mounting section of the lower side plates of the lower cover member is arranged in a continuous smooth form or comprises spaced grooves formed therein. The engaging section of the upper side plates forms bumps corresponding to the grooves. The bumps are receivable in the grooves to secure the upper cover member and the lower cover member together.

The efficacy of the present invention is that the present invention provides a liquid crystal glass panel packaging box that forms a raised portion on the bottom of the lower cover member to allow multiple packaging boxes to be stacked over each other and also allow the lower cover members to be stacked with other lower cover members thereby making it possible to feed the liquid crystal glass panels in multiplicity in a subsequent assembling operation, improving feeding performance of an operator, reducing working hours, and thus improving manufacture performance and lowering down manufacture cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, will be apparent from the following detailed description of an embodiment of the present invention, with reference to the attached drawings. In the drawings.

DETAILED DESCRIPTION OF THE PREFERRED EMBODIMENTS

Figure 1:
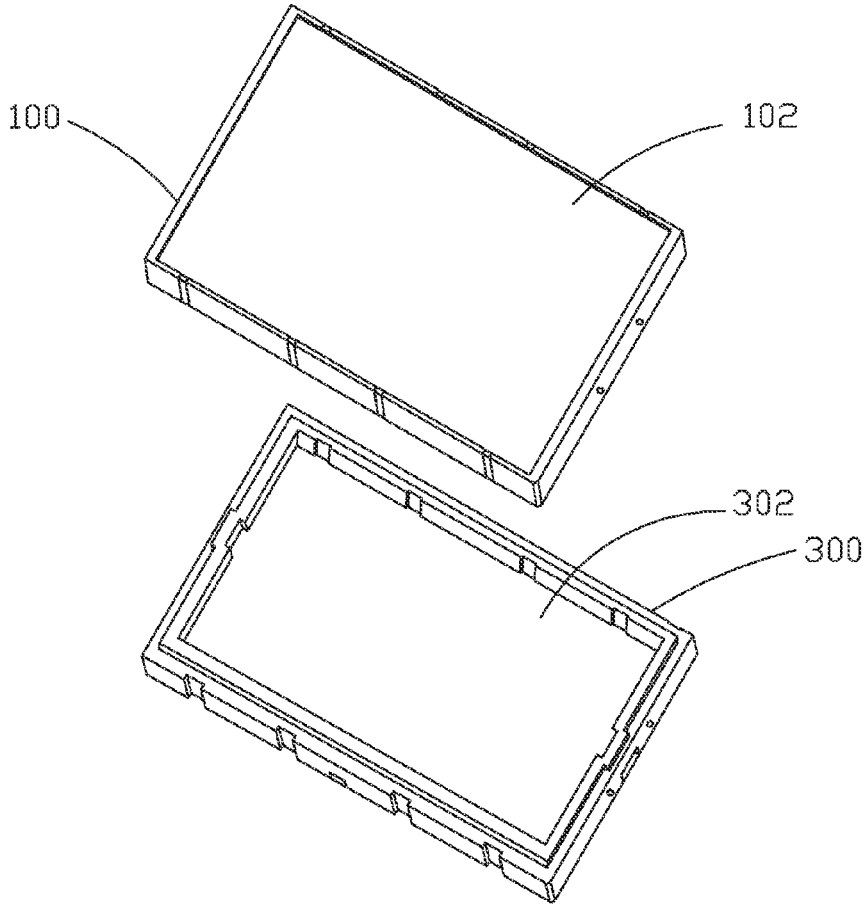
Fig. 1 (Prior Art)
FIG. 1 is an exploded view showing a conventional liquid crystal glass panel packaging box.
Figure 2:
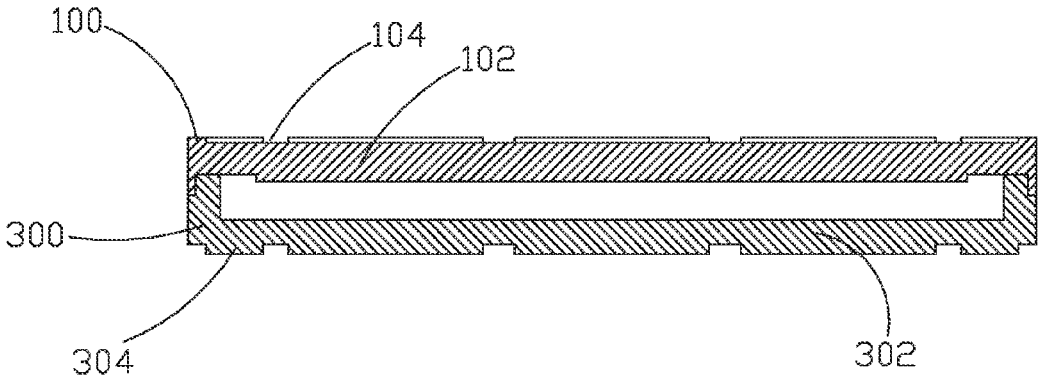
Fig. 2 (Prior Art)
FIG. 2 is a cross-sectional view showing the conventional liquid crystal glass panel packaging box in an assembled form.
Figure 3:
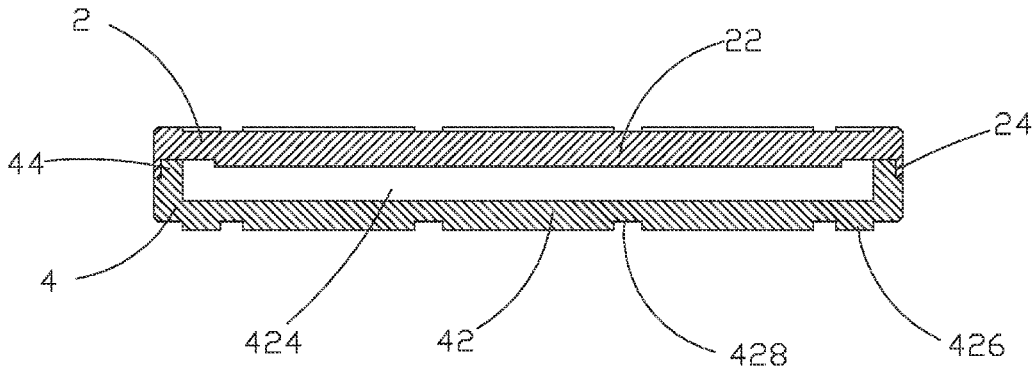
FIG. 3 is a cross-sectional view showing a liquid crystal glass panel packaging box according to the present invention.

To further expound the technical solution adopted in the present invention and the advantages thereof, a detailed description is given to a preferred embodiment of the present invention and the attached drawings.

Referring to FIGS. 3-8, the present invention provides a liquid crystal glass panel packaging box, which comprises: an upper cover member 2 and a lower cover member 4 that is mateable with the upper cover member 2. The upper cover member 2 comprises a top plate 22 and upper side plates 24 connected to the top plate 22. The lower cover member 4 comprises a bottom plate 42 and lower side plates 44 connected to the bottom plate 42. The lower side plates 44 and the bottom plate 42 collectively define a receiving chamber 424 having an opening for receiving a liquid crystal glass panel (not shown) therein. The upper cover member 2 is set in mating engagement with the lower cover member 4 that receives the liquid crystal glass panel therein to complete the packaging box for liquid crystal glass panel packaging box.

Figure 7:
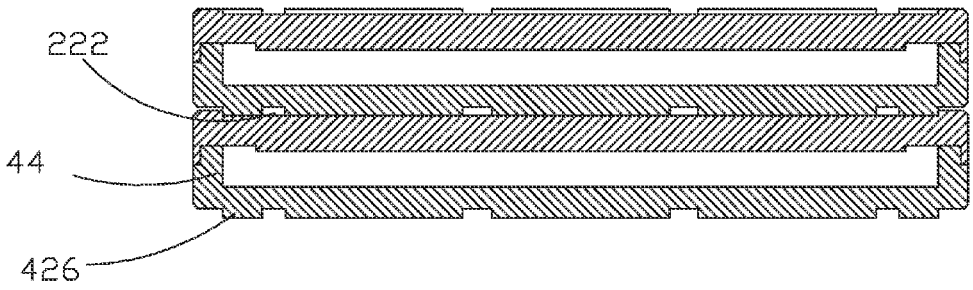
FIG. 7 is a cross-sectional view of an embodiment of the present invention showing two liquid crystal glass panel packaging boxes stacked over each other.
Figure 8:
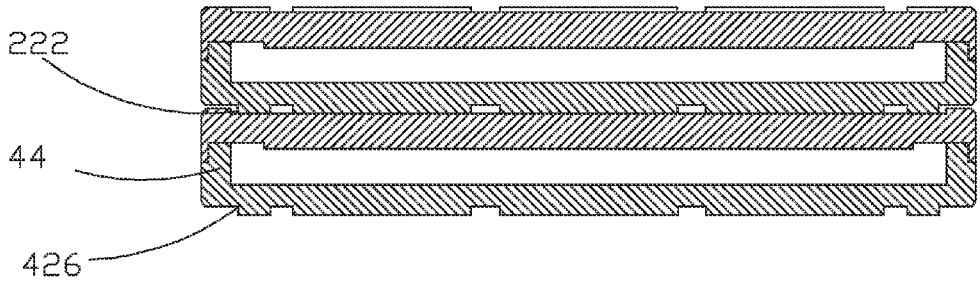
FIG. 8 is a cross-sectional view of another embodiment of the present invention showing two liquid crystal glass panel packaging boxes stacked over each other.

The bottom plate 42 of the lower cover member 4 has an outside surface 422 that is away from the receiving chamber 424 forms a raised portion 426 that corresponds to a circumference of the opening of the receiving chamber 424. The raised portion 426 has an outer circumference that is in alignment with an inner circumference of the lower side plates 44 (as shown in FIG. 7) or is inwardly shifted with respect to the inner circumference of the lower side plates 44 (as shown in FIG. 8), whereby the raised portion 426 of the lower cover member 4 of one liquid crystal panel packaging box is receivable in the opening of the receiving chamber 424 of the lower cover member 4 of another liquid crystal panel packaging box to effect stacking of two lower cover members 42 of different liquid crystal panel packaging boxes.

The raised portion 426 is of a rectangular structure. In the instant embodiment, the raised portion 426 forms a plurality of grooves 428. A raised portion 426 of such a structural arrangement helps reducing material used and also reducing the overall weight of the lower cover member 4, lowering down manufacture cost and at the same time allowing of easy handling by an operator.

The top plate 22 of the upper cover member 2 has a top surface that forms a receiving cavity 222 corresponding to the raised portion 426 of the bottom plate 42 of the lower cover member 4. The receiving cavity 222 of the top plate 22 of the upper cover member 2 has a circumference that corresponds to the outer circumference of the raised portion 426 (as shown in FIG. 7) or is shifted outward with respect to the outer circumference of the raised portion 426 (as shown in FIG. 8), whereby the raised portion 426 of the bottom plate 42 of the lower cover member 4 of one liquid crystal panel packaging box is receivable in the receiving cavity 222 of the top plate 22 of the upper cover member 2 of another liquid crystal panel packaging box to effect stacking between the lower cover member 4 and the upper cover member 2 of different liquid crystal panel packaging boxes.

Figure 4:
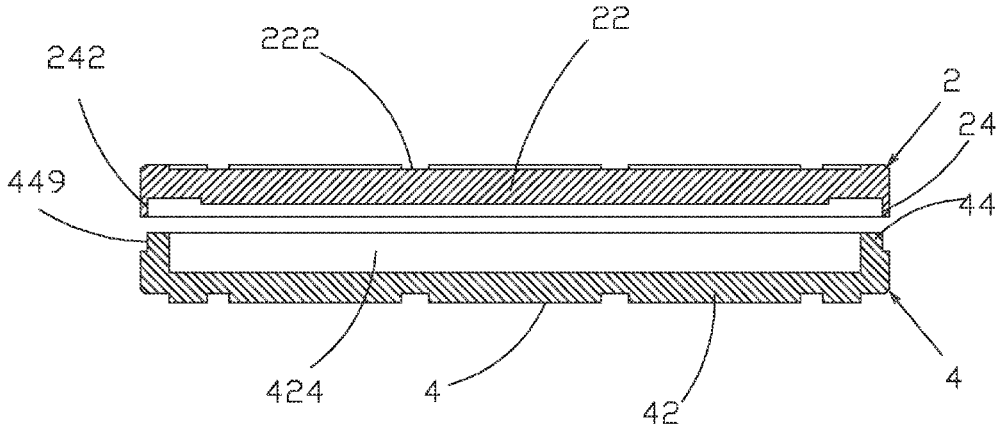
FIG. 4 is schematic view showing a condition where upper and lower cover members are separated.
Figure 5:
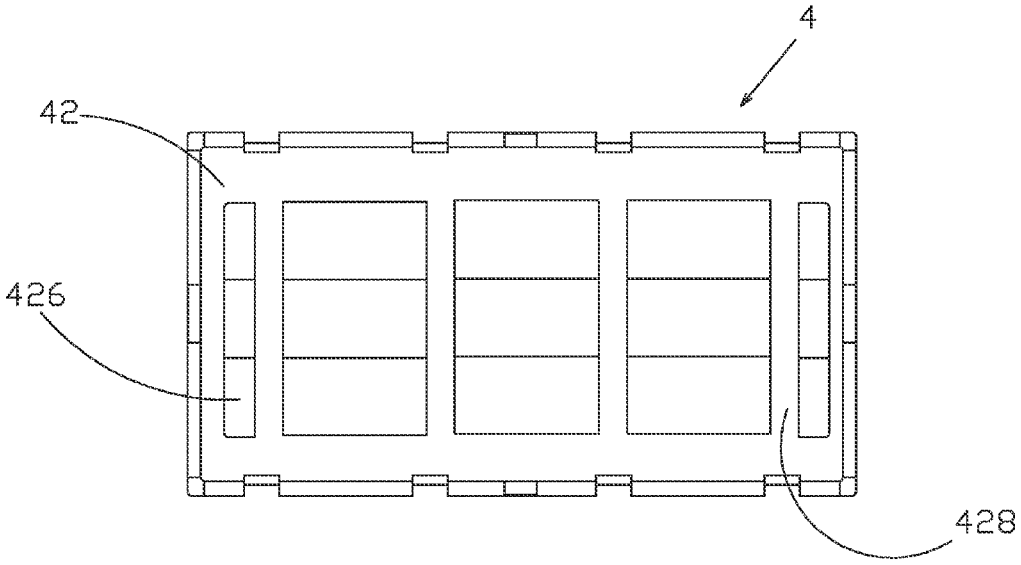
FIG. 5 a schematic view showing a bottom of the lower cover member of an embodiment of the liquid crystal glass panel packaging box according to the present invention.
Figure 6:
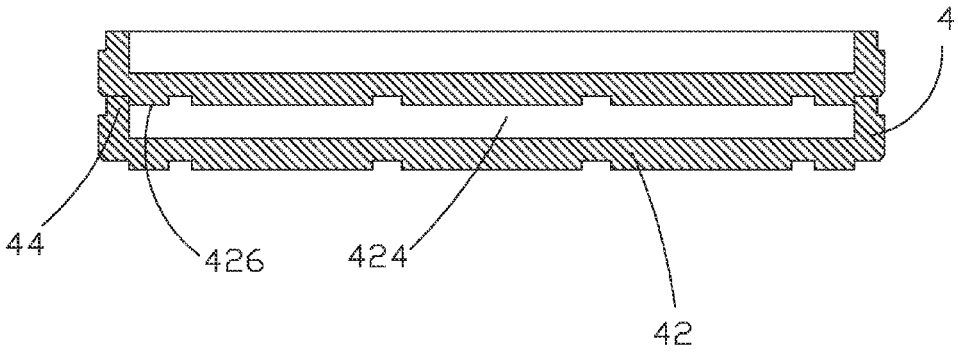
FIG. 6 is a cross-sectional view showing two lower cover members of the liquid crystal glass panel packaging boxes according to the present invention stacked over each other.

Referring to FIG. 4, the lower side plates 44 of the lower cover member 4 form a mounting section 449 in outside surfaces thereof at ends adjacent to the upper cover member 2. The upper side plates 24 of the upper cover member 2 form an engaging section 242, which corresponds to the mounting section 449, in inside surfaces thereof at ends adjacent to the lower cover member 4 to mate and couple with the mounting section 449, thereby effecting mating engagement between the upper cover member 2 and the lower cover member 4.

Preferably, the mounting section 449 of the lower side plates 44 of the lower cover member 4 is arranged in a continuous smooth form or comprises spaced grooves formed therein. The engaging section 242 of the upper side plates 24 forms bumps corresponding to the grooves. The bumps are receivable in the grooves to secure the upper cover member 2 and the lower cover member 4 together.

To package a liquid crystal glass panel with the present invention, the liquid crystal glass panel is first positioned in the receiving chamber 424 of the lower cover member 4. And then, the upper cover member 2 is set on and mates the lower cover member 4 to enclose the liquid crystal glass panel therebetween. Multiple packaging boxes can be stacked and in doing the stacking, the raised portion 426 on the bottom of the lower cover member 4 of one packaging box is fit into the receiving cavity 222 on the top of the upper cover member 2 of another packaging box to have the two packaging boxes stacked over each other. To feed to liquid crystal glass panels enclosed in the packaging boxes to a manufacture line for assembling operation, an operator may put in multiple boxes simultaneously. Since the liquid crystal glass panel is generally deposited in the lower cover member 4, in feeding to the manufacture line, the upper cover members 2 of the multiple packaging boxes are removed to allow the lower cover members 4 that hold the liquid crystal glass panels therein to be stacked over each other, thereby helping the operator to feed the multiple boxes at the same time. The feeding performance is improved, working hours are reduced, and thus the manufacture performance is improved and lowering down manufacture cost.

In summary, the present invention provides a liquid crystal glass panel packaging box that forms a raised portion on the bottom of the lower cover member to allow multiple packaging boxes to be stacked over each other and also allow the lower cover members to be stacked with other lower cover members thereby making it possible to feed the liquid crystal glass panels in multiplicity in a subsequent assembling operation, improving feeding performance of an operator, reducing working hours, and thus improving manufacture performance and lowering down manufacture cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal glass panel packaging box, comprising an upper cover member and a lower cover member that is mateable with the upper cover member, the upper cover member comprising a top plate and upper side plates connected to the top plate, the lower cover member comprising a bottom plate and lower side plates connected to the bottom plate, the lower side plates and the bottom plate collectively defining a receiving chamber having an opening adapted to receive a liquid crystal glass panel therein, the bottom plate of the lower cover member having an outside surface that is away from the receiving chamber and forms a raised portion that corresponds to a circumference of the opening of the receiving chamber, whereby the raised portion of the lower cover member of the liquid crystal panel packaging box is adapted to be selectively received in the opening of the receiving chamber of the lower cover member of an additional liquid crystal panel packaging box that is identical to the liquid crystal glass panel packaging box to effect stacking of lower cover members of different liquid crystal panel packaging boxes;

wherein the lower side plates of the lower cover member form a mounting section in outside surfaces thereof at ends adjacent to the upper cover member and the upper side plates of the upper cover member form an engaging section, which corresponds to the mounting section, in inside surfaces thereof at ends adjacent to the lower cover member to mate and couple with the mounting section, thereby effecting mating engagement between the upper cover member and the lower cover member; and wherein the mounting section of the lower side plates of the lower cover member is arranged in a continuous smooth form or comprises spaced grooves formed therein, the engaging section of the upper side plates forming bumps corresponding to the grooves, the bumps being receivable in the grooves to secure the upper cover member and the lower cover member together.

2. The liquid crystal glass panel packaging box as claimed in claim 1, wherein the top plate of the upper cover member has a top surface forming a receiving cavity corresponding to the raised portion of the bottom plate of the lower cover member to allow the raised portion of the bottom plate of the lower cover member of the liquid crystal panel packaging box to be receivable in the receiving cavity of the top plate of the upper cover member of said additional liquid crystal panel packaging box to effect stacking between the lower cover member and the upper cover member of different liquid crystal panel packaging boxes.

3. The liquid crystal glass panel packaging box as claimed in claim 2, wherein the receiving cavity of the top plate of the upper cover member has a circumference that corresponds to an outer circumference of the raised portion or is shifted outward with respect to the outer circumference of the raised portion.

4. The liquid crystal glass panel packaging box as claimed in claim 1, wherein the raised portion has an outer circumference that is in alignment with an inner circumference of the lower side plates or is inwardly shifted with respect to the inner circumference of the lower side plates.

5. The liquid crystal glass panel packaging box as claimed in claim 1, wherein the raised portion is of a rectangular structure.

6. The liquid crystal glass panel packaging box as claimed in claim 5, wherein the raised portion forms a plurality of grooves.

7. A liquid crystal glass panel packaging box, comprising an upper cover member and a lower cover member that is mateable with the upper cover member, the upper cover member comprising a top plate and upper side plates connected to the top plate, the lower cover member comprising a bottom plate and lower side plates connected to the bottom plate, the lower side plates and the bottom plate collectively defining a receiving chamber having an opening adapted to receive a liquid crystal glass panel therein, the bottom plate of the lower cover member having an outside surface that is away from the receiving chamber and forms a raised portion that corresponds to a circumference of the opening of the receiving chamber, whereby the raised portion of the lower cover member of the liquid crystal panel packaging box is adapted to be selectively received in the opening of the receiving chamber of the lower cover member of an additional liquid crystal panel packaging box that is identical to the liquid crystal glass panel packaging box to effect stacking of lower cover members of different liquid crystal panel packaging boxes;

wherein the top plate of the upper cover member has a top surface forming a receiving cavity corresponding to the raised portion of the bottom plate of the lower cover member to allow the raised portion of the bottom plate of the lower cover member of the liquid crystal panel packaging box to be receivable in the receiving cavity of the top plate of the upper cover member of said additional liquid crystal panel packaging box to effect stacking between the lower cover member and the upper cover member of different liquid crystal panel packaging boxes;

wherein the receiving cavity of the top plate of the upper cover member has a circumference that corresponds to an outer circumference of the raised portion or is shifted outward with respect to the outer circumference of the raised portion;

wherein the raised portion has an outer circumference that is in alignment with an inner circumference of the lower side plates or is inwardly shifted with respect to the inner circumference of the lower side plates;

wherein the raised portion is of a rectangular structure;

wherein the raised portion forms a plurality of grooves;

wherein the lower side plates of the lower cover member form a mounting section in outside surfaces thereof at ends adjacent to the upper cover member and the upper side plates of the upper cover member form an engaging section, which corresponds to the mounting section, in inside surfaces thereof at ends adjacent to the lower cover member to mate and couple with the mounting section, thereby effecting mating engagement between the upper cover member and the lower cover member; and wherein the mounting section of the lower side plates of the lower cover member is arranged in a continuous smooth form or comprises spaced grooves formed therein, the engaging section of the upper side plates forming bumps corresponding to the grooves, the bumps being receivable in the grooves to secure the upper cover member and the lower cover member together.

* * * * *